United States Patent [19]

Ludlow et al.

[11] 4,382,633

[45] May 10, 1983

[54] LONGWALL MINING SYSTEM

[75] Inventors: Jonathan E. Ludlow, Arlington, Mass.; Cecil V. Peake, Bethlehem, Pa.; Paul J. Guay, Stoughton, Mass.

[73] Assignee: Foster-Miller Associates, Inc., Waltham, Mass.

[21] Appl. No.: 237,623

[22] Filed: Feb. 24, 1981

[51] Int. Cl.[3] ..... E21C 27/24; E21C 29/02

[52] U.S. Cl. ..... 299/33; 299/43

[58] Field of Search ..... 299/31-33, 299/43, 45, 87, 71, 11, 18, 44, 46-48, 80, 81, 89

[56] References Cited

U.S. PATENT DOCUMENTS

| | | | |
|---|---|---|---|
| 2,716,025 | 8/1955 | Malloy et al. | 299/18 X |
| 3,290,096 | 12/1966 | Stalker | 299/78 |
| 3,954,302 | 5/1976 | Browning | 299/81 |
| 3,958,830 | 5/1976 | Johns | 299/11 X |

FOREIGN PATENT DOCUMENTS

| | | | |
|---|---|---|---|
| 704681 | 2/1954 | United Kingdom | 299/45 |
| 318692 | 12/1971 | U.S.S.R. | 299/43 |

*Primary Examiner*—Ernest R. Purser

*Attorney, Agent, or Firm*—Herbert L. Bello

[57] ABSTRACT

A longwall mining system includes a bidirectional shearer and a roof supporting structure. The shearer includes a pair of angled floor drums, a pivotable roof drum and a loading conveyor. Each drum has a plurality of picks disposed about the drum surface for cutting a material to be mined and a plurality of vanes disposed on the drum surface for carrying the cut material to the loading conveyor. The roof supporting structure includes a load carrying shield which is braced by a pair of supports. The supports are located under the shield in a position between the shearer and a face conveyor. The face conveyor, which is fed by the loading conveyor, carries the mined material to main conveyor for haulage to the outside.

15 Claims, 6 Drawing Figures

LONGWALL MINING SYSTEM

BACKGROUND OF THE INVENTION

1. Field of the Invention

The present invention relates to mining systems and, more particularly, is directed toward a longwall mining system.

2. Description of the Prior Art

In a longwall coal mining system, a shearer having a cutting head with a plurality of picks disposed in a helical path about the head surface is traversed back and forth along the seam's face, cutting off a layer of coal during each traverse. The helically configured drum defines a screw conveyor which carries the coal from the face back toward a face conveyor. The cut coal, which is dropped onto the face conveyor by the auger action of the helically disposed picks, is carried to a main conveyor for hauling to the outside. In such systems, shields are provided to support the roof of the mine near the face in order to prevent collapse of the roof. U.S. Pat. No. 4,045,087 shows a longwall mining system roof support. Since the cut coal is merely dropped onto the face conveyor, it is necessary to position the face conveyor adjacent the shearer. Such longwall mining systems have suffered from the disadvantage that the face can be cut a minimal amount on each traverse. The depth of cut is limited because of the instability of the shearer and the inefficient loading techniques inherent in a helical head configuration. Since the cutting heads are supported from one end only on a cantalever arm, the heads are made narrow to minimize instability. The auger action of loading coal by dropping it onto the face conveyor produces excessive dust.

SUMMARY OF THE INVENTION

It is an object of the present invention to provide a longwall mining system that does not suffer from the heretofore mentioned disadvantages.

Another object of the invention is to provide a longwall mining system with a bidirectional, multiple drum shearer and roof supporting structure for the mining of very deep webs in high seams.

A further object of the present invention is to provide a longwall mining system that is stable and efficient. The mining system is characterized by a bidirectional shearer and a cooperating roof supporting structure. The shearer includes a pair of angled floor drums, a pivotable roof drum, and a loading conveyor. Each drum has a plurality of picks disposed about its surface for cutting a material to be mined. Vanes located on the surface of each drum carry the cut material to the loading conveyor. The drums are driven by motors which are housed within the drums. The roof supporting structure includes a shield that is braced by a pair of supports. The supports are located under the shield in a position between the shearer and a face conveyor. The face conveyor, which is loaded from the loading conveyor, carries the mined material to a main conveyor for haulage to the outside.

Other objects of the present invention will in part be obvious and will in part appear hereinafter.

The invention accordingly comprises the system and apparatus, together with their parts, elements and interrelationships that are exemplified in the following disclosure, the scope of which will be indicated in the appended claims.

BRIEF DESCRIPTION OF THE DRAWINGS

A fuller understanding of the nature and objects of the present invention will become apparent on consideration of the following detailed description taken in connection with the accompanying drawings, wherein.

DESCRIPTION OF THE PREFERRED EMBODIMENTS

Figure 1:
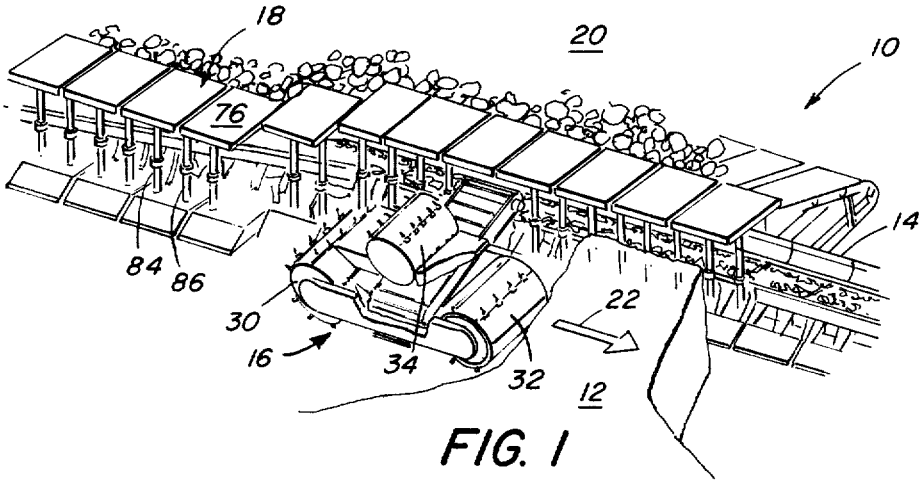
FIG. 1 is a perspective view of a longwall mining system embodying the present invention.

Referring now to the drawings, particularly FIG. 1, there is shown a longwall mining system 10 embodying the present invention for mining an underground mineral deposit 12, for example underground deposits of coal, potash, trona or other mineral deposits normally found in discrete seams. Longwall mining system 10 includes a bidirectional shearer 16 and cooperating roof supporting structure 18. As shearer 16 is traversed back and forth along the seam's face, a layer of the mineral deposit, for example coal, is cut off during each traverse. Shearer 16 deposits the cut coal onto a face conveyor 14 which carries the mined material to a main conveyor (not shown) for haulage to the outside. As shearer 16 cuts into the seam's face and moves forward, the portion roof supporting structure 18 behind the shearer is pulled toward the cut seam. As roof supporting structure 18 moves forward, the roof of the mined space behind the roof supporting structure caves in and creates a gob area 20. In the illustrative embodiment of FIG. 1, shearer 16 is moving toward the right as denoted by the arrow 22. When shearer 16 reaches the right-hand end of the seam face to be cut, the left-hand end of the shearer is angled into the seam's face. Shearer 16 is now moved toward the left along the seam's face, a layer of coal being cut during this traverse. As hereinafter described in connection with FIGS. 2, 3 and 4, shearer 16 is moved bidirectionally along a track 24 by hauling drives 26.

Figure 2:
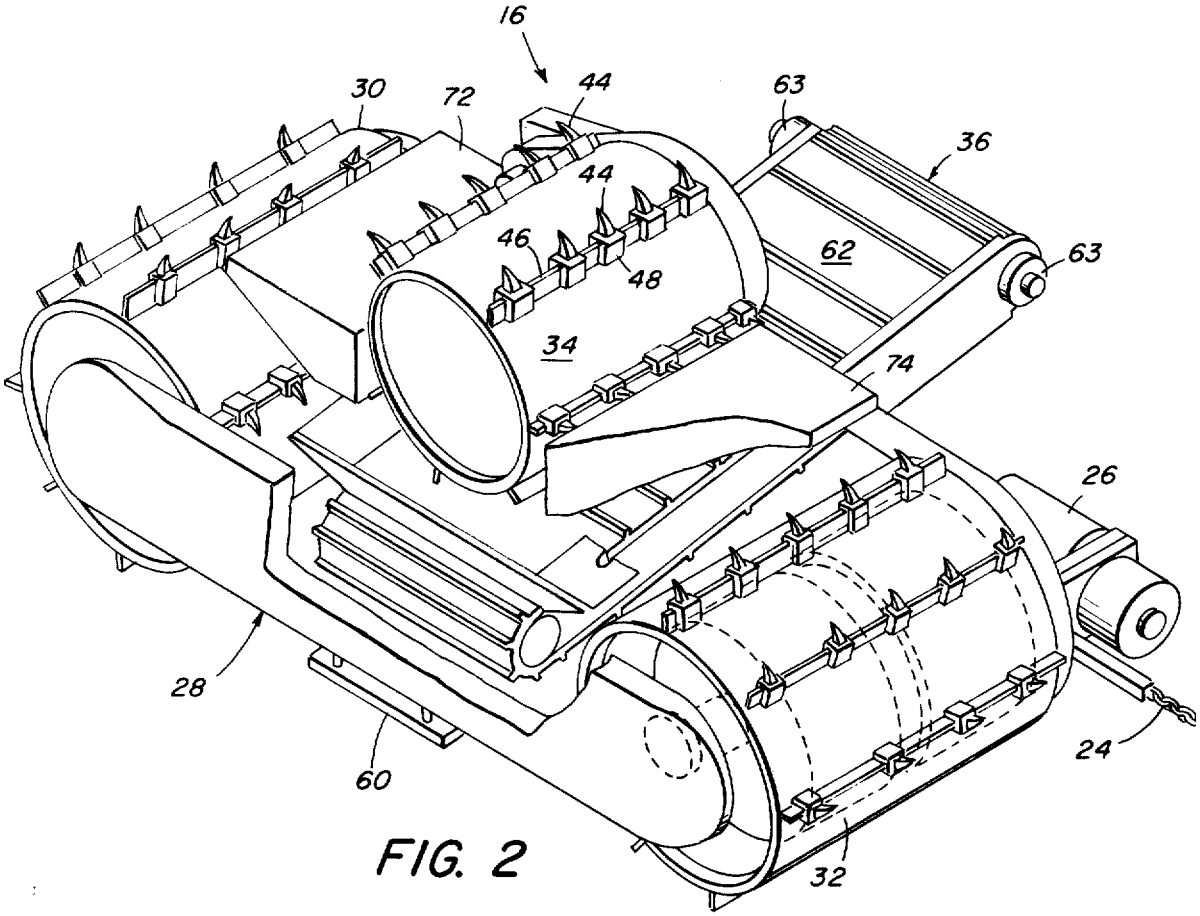
FIG. 2 is a perspective view of the shearer of FIG. 1.
Figure 3:
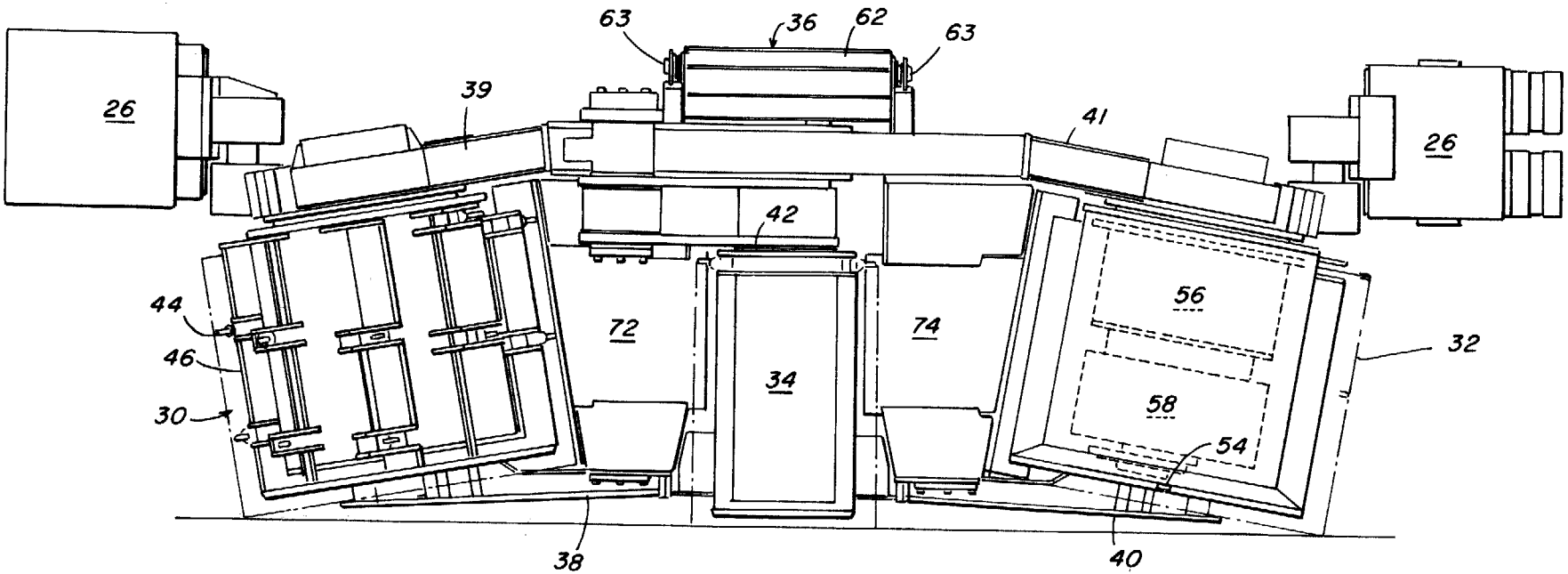
FIG. 3 is a top plan view of the shearer of FIG. 2.
Figure 4:
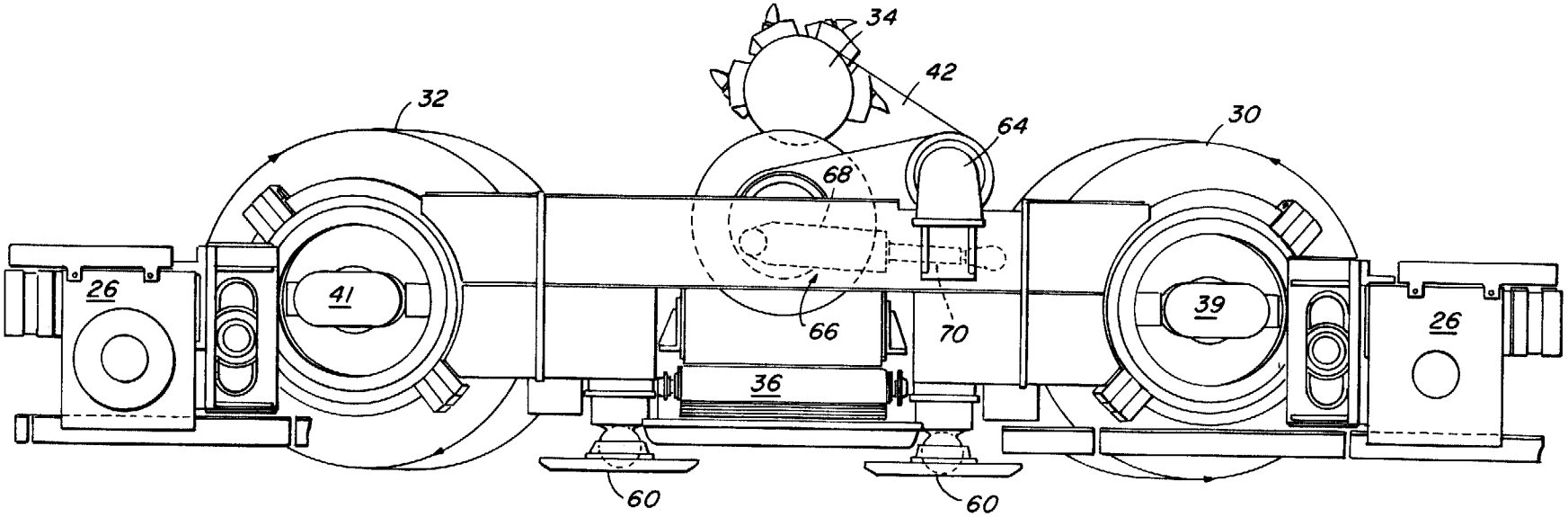
FIG. 4 is a side elevation of the shearer of FIG. 3.
Figure 5:
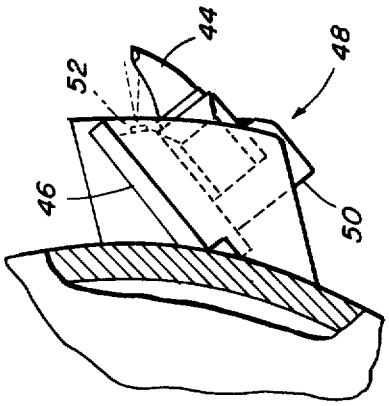
FIG. 5 is a side elevation of the vane and pick assembly of FIG. 2.

Referring now to FIGS. 2, 3 and 4, it will be seen that shearer 16 includes a frame 28 which carries a pair of floor drums 30, 32, a roof drum 34, and a loading conveyor 36. Opposite ends of floor drum 30 are rotatably supported to arms 38 and 39 which are mounted to frame 28 at the face and gob sides of the mine, respectively. Similarly, floor drum 32 is rotatably supported at its ends on arms 40 and 41 which are mounted to frame 28. One end of roof drum 34 is rotatably mounted to a ranging arm 42 on the gob side of shearer 16, the ranging arm being pivotally connected to frame 28. A plurality of picks 44, composed of tungsten carbide steel, for example, are mounted on the surface of each drum 30, 32 and 34. A plurality of vanes or paddles 46 are mounted on the surface of each drum 30, 32 and 34, the vanes extending the length of the drum. In the illustrative embodiment, by way of example, each drum 30, 32 and 34 is provided with a plurality of holders 48 that are axially disposed along the drum surfaces. As best shown in FIG. 5, each holder 48 includes a base 50 for holding a pick 44. In the preferred embodiment, picks 48 are disposed in axial rows along the surface of each drum 30, 32 and 34. Vanes 46 are disposed in axial rows on the surface of each drum 30, 32 and 34 adjacent each row of picks 44. Also mounted to base 50 is a nozzle 52 which directs a water spray toward the tip of picks 44. The water spray is operative to minimize dust in the mining area. Arms 38 and 40 are provided with a conduit 54 which directs air into the mined area in order to dilute the concentration of methane gas produced during the coal mining operation.

As best shown in FIG. 3, floor drums 30 and 32 are angled inwardly from the face side of shearer 16 at an angular offset in the range of 6° to 15°, preferably 10°. Roof drum 34, on the other hand, is disposed substantially perpendicular to a longitudinal axis of shearer 16. That is, roof drum 34 is rotatable about a first axis which is substantially perpendicular to the seam's face and to a longitudinal axis of shearer 16, drum 30 is rotatable about a second axis and floor drum 32 is rotatable about a third axis. The second and third axes are angularly offset from the first axis by approximately 10°.

In the illustrative embodiment, by way of example, floor drums 30 and 32 are approximately 6.5 feet in diameter and roof drum 34 is approximately 3.5 feet in diameter. Mounted within each drum 30, 32 and 34 is a motor 56 and a gear assembly 58. Although only the motor and gear assembly are shown for floor drum 32, it is to be understood that a similar motor and gearing arrangement is provided for floor drum 30 and roof drum 34. In the illustrated embodiment, by way of example, the floor drum motors are 375 horsepower electric motors and the roof drum motor is a 140 horsepower motor. Each electric motor 56 is a double ended motor, one end of the motor shaft is connected to gear assembly 58 for driving the respective drum and the other end of the motor shaft provides hydraulic power for driving conveyor 36, hauling devices 26 and a plurality of support pads 60.

Roof drum 34 is rotatably mounted to ranging arm 42 which is pivoted about a bracket 64. Roof drum 34 is moved between its lower position and its upper position by means of a hydraulic jack 66 having a cylinder 68 and a reciprocating piston 70. Cylinder 68 is pivotably mounted to one end of ranging arm 42 and piston 70 is pivotably mounted to bracket 64. A pair of canopies 72 and 74 are mounted on either side of roof drum 34. Canopy 72 is pivotably mounted to frame 28 adjacent roof drum 34 so that it can be moved into an upward position to form a chute for feeding the material cut by the roof drum 34 onto loading conveyor 36 when shearer 16 is moving toward the left. Canopies 72 and 74 define a chute for the material cut by floor drums 30 and 32. That is, canopies 72 and 74 direct the material cut by floor drums 30 and 32 onto loading conveyor 36.

Loading conveyor 36, which defines means for carrying the cut material away from shearer 16, is disposed between floor drums 30 and 32 and below roof drum 34. In the illustrated embodiment, by way of example, loading conveyor 36 includes a belt 62 that is driven by a pair of hydraulic motors 63 and travels at a rate of 750 feet per minute. Loading conveyor 36 feeds face conveyor 14 which is positioned in roof supporting structure 18.

Figure 6:
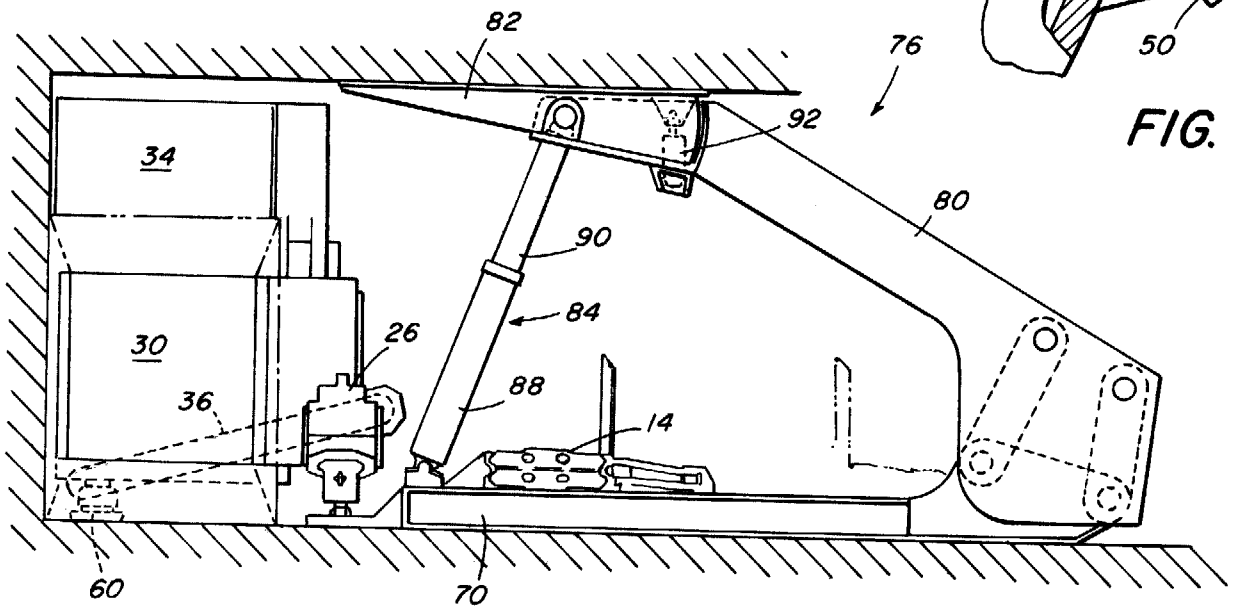
FIG. 6 is a side elevation of the roof supporting structure and shearer of FIG. 1.

Roof supporting structure 18 includes a plurality of self-advanceable roof supports 76 that are arranged side by side along the face of the seam. Each support 76 includes a base 78, a supporting arm 80, a roof load supporting shield 82 and a pair of shield supporting members 84, 86. One end of supporting arm 80 is pivotably mounted to one end of base 78 and shield 82 is pivotably mounted to the other end of arm 80. In the illustrated embodiment, by way of example, each shield supporting member 84, 86 is a hydraulic leg having a cylinder 88 and a reciprocating piston 90. One end of cylinder 88 is pivotably mounted to the other end of base 78 and the end of piston 90 is pivotably mounted to shield 82. From the foregoing, it will be readily appreciated that hydraulic legs 84, 86 are under the roof load which is supported by shield 82. A hydraulic jack 92 which is pivotably mounted to arm 80 and shield 82 is provided for stabilizing shield 82 against the roof of the mine. As shown in FIG. 6, face conveyor 14 is carried on base 78 between shearer 16 and hydraulic legs 84, 86.

In operation of longwall mining system 10, shearer 16 is traversed back and forth along the seam's face by hauling devices 26. As shearer 16 is traversed back and forth along the face, a layer of the mineral deposit is cut off by floor drums 30, 32 and roof drum 34. The cut material is deposited onto loading conveyor 36 and carried to face conveyor 14. The face conveyor deposits the mined material on the main conveyor for haulage to the outside.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A longwall mining system for mining an underground mineral deposit and loading the mined material on a face conveyor, said system comprising:

(a) a shearer with at least one rotatable drum and carrying means, said drum having a plurality of picks disposed about its surface for cutting the material to be mined, a plurality of vanes mounted in axial rows on the surface of said drum for carrying the cut material on the drum, said carrying means mounted adjacent said drum for receiving the material cut by said picks and carried by said vanes; and (b) roof supporting means operative to support the roof of a mine adjacent said shearer.

2. The longwall mining system as claimed in claim 1 wherein said shearer includes a pair of floor drums and a pivotable roof drum, each said drum having a plurality of picks that are mounted in axial rows on its surface; each said floor drum supported at its face and gob sides, each said floor drum angled inwardly from the face side of said shearer.

3. The longwall mining system as claimed in claim 2 wherein said vanes are axially disposed on the surface of each said drum adjacent each said row of picks.

4. The longwall mining system as claimed in claim 3 including driver means mounted within each said drum, said driver means rotating said drum in which it is mounted.

5. A longwall mining system for mining an underground mineral deposit and loading the mined material on a face conveyor, said system comprising:

(a) a shearer with at least one rotatable drum and carrying means, said drum having a plurality of picks disposed about its surface for cutting the material to be mined, a plurality of vanes mounted on the surface of said drum for carrying the cut material on the drum, said carrying means mounted adjacent said drum for receiving the material cut by said picks and carried by said vanes; and (b) roof supporting means operative to support the roof of a mine adjacent said shearer;

(c) said shearer including a frame, a pair of angled floor drums, and a roof drum, said floor drums mounted at opposite ends of said frame, each said floor drum supported at its face and gob sides, said roof drum pivotably mounted to said frame, said floor drums angled inwardly from the face side of said shearer at an angular offset in the range of 6° to 15°.

6. The longwall mining system as claimed in claim 5 wherein said roof drum is rotatable about a first axis which is substantially perpendicular to a longitudinal axis of said shearer, one of said floor drums rotatable about a second axis, the other of said floor drums rotatable about a third axis, said second and third axes angularly offset from said first axis approximately 10°.

7. The longwall mining system as claimed in claim 6 wherein said carrying means is a loading conveyor, said loading conveyor is mounted between said floor drums and under said roof drum.

8. The longwall mining system as claimed in claim 7 wherein said roof supporting means includes a plurality of roof supporting structures, each said roof supporting structure including a base, an arm, a shield and a pair of supports, said arm pivotably mounted to said base, said shield mounted to said arm, each of said supports mounted to said shield and said base, said shield braced by said supports, said supports positioned between said shearer and the face conveyor.

9. A longwall mining system for mining an underground mineral deposit and loading the mined material on a face conveyor, said system comprising:

(a) a shearer for mining a mineral deposit, said shearer including a pair of angled floor drums, a roof drum and means for carrying the mined mineral to the face conveyor; and (b) a plurality of roof supporting means for supporting the roof of a mine adjacent said shearer, each said roof support means includes a base, supporting body means and supporting member means, said supporting body means mounted to said base and operative to support a roof load, said supporting member means having first and second ends, said first end of said supporting member means mounted to said base under said supporting body means, said second end of said supporting member means mounted to said supporting body means above said base, said support member means positioned between said shearer and the face conveyor.

10. The longwall mining system as claimed in claim 9 wherein said supporting body means includes an arm and a shield, one end of said arm pivotably mounted to said base, said second end of said support member means mounted to said arm, said shield mounted to the other end of said arm and wherein said supporting member means includes a pair of hydraulic legs, one end of each said hydraulic leg pivotably mounted to said base, the other end of each said hydraulic leg pivotably mounted to said arm.

11. The longwall mining system as claimed in claim 10 wherein each said drum has a plurality of picks disposed on its surface, a plurality of vanes mounted on the surface of each said drum.

12. A shearer for a longwall mining system comprising:

(a) a frame;

(b) a pair of floor drums rotatably mounted at opposite ends of said frame, said floor drums angled inwardly from opposite ends of said frame toward a center of said frame at the face side thereof;

(c) a ranging arm pivotably mounted to said frame;

(d) a roof drum rotatably mounted to said ranging arm;

(e) a plurality of picks mounted on the surface of each said drum, said picks operative to cut a material to be mined; and (f) a plurality of vanes disposed in axial rows on the surface of each said drum for carrying the material cut by said picks.

13. The shearer as claimed in claim 12 including a loading conveyor mounted to said frame between said floor drums and below said roof drum, said material carried by said vanes dropped onto said loading conveyor.

14. The shearer as claimed in claim 12 including water spray means adjacent each of said picks for spraying water at a face being worked and air moving means mounted within said frame moving air into an area being worked.

15. A shearer for a longwall mining system comprising:

(a) a frame;

(b) a pair of floor drums rotatably mounted at opposite ends of said frame, said floor drums are angled inwardly approximately 10° for opposite ends of said frame toward a center of said frame at the face side thereof;

(c) a ranging arm pivotably mounted to said frame;

(d) a roof drum rotatably mounted to said ranging arm;

(e) a plurality of picks mounted on the surface of each said drum, said picks operative to cut a material to be mined;

(f) a plurality of vanes disposed on the surface of each said drum for carrying the material cut by said picks; and (g) a loading conveyor mounted to said frame between said floor drums and below said roof drum, said material carried by said vanes dropped onto said loading conveyor.

* * * * *